US007347677B2

(12) United States Patent
Ide et al.

(10) Patent No.: US 7,347,677 B2
(45) Date of Patent: Mar. 25, 2008

(54) VANE PUMP

(75) Inventors: Norikazu Ide, Tokyo (JP); Tomoyuki Fujita, Tokyo (JP); Hideyasu Ihira, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 293 days.

(21) Appl. No.: 11/142,680

(22) Filed: Jun. 2, 2005

(65) Prior Publication Data

US 2005/0281690 A1 Dec. 22, 2005

(30) Foreign Application Priority Data

Jun. 17, 2004 (JP) ..... 2004-179187

(51) Int. Cl.
*F03C 4/00* (2006.01)
*F04C 15/00* (2006.01)

(52) U.S. Cl. ..... 418/132; 418/133; 418/179; 418/259

(58) Field of Classification Search ..... 418/131–133, 418/179, 259, 260, 266–268, 149
See application file for complete search history.

(56) References Cited

U.S. PATENT DOCUMENTS 2,036,028 A * 3/1936 Evans, Jr. ..... 418/133
2,083,560 A 6/1937 Grey et al.
3,664,776 A * 5/1972 Mills et al. ..... 418/133
3,964,844 A 6/1976 Whitmore et al.
6,120,270 A 9/2000 Parsch
6,666,670 B1 * 12/2003 Hartman et al. ..... 418/133

FOREIGN PATENT DOCUMENTS

| | | | |
|---|---|---|---|
| DE | 28 35 816 | 8/1978 | |
| DE | 3303247 A1 * | 8/1983 | ..... 418/104 |
| DE | 295 05 568 | 3/1995 | |
| DE | 196 26 206 | 6/1996 | |
| EP | 1 312 802 A2 | 5/2003 | |
| ES | 488724 A1 | 9/1980 | |
| JP | 07-279871 | 10/1995 | |
| JP | 07279871 | 10/1995 | |
| JP | 10176687 A * | 6/1998 | |

* cited by examiner

*Primary Examiner*—Theresa Trieu
(74) *Attorney, Agent, or Firm*—Rabin & Berdo, PC

(57) ABSTRACT

A body bore 2 formed in a body 1 is closed with a cover 9, as well as a cam ring 4 is incorporated into the body bore 2, and a rotor 6 is arranged inside the cam ring 4. Vanes 7 move in and out along an inner surface of the cam ring 4 with rotation of the rotor 6. An iron reinforcing plate 8 is interposed inside the body bore 2 between the cam ring 4 and the cover 9.

2 Claims, 4 Drawing Sheets

VANE PUMP

BACKGROUND OF THE INVENTION

1. Field of the Invention

The present invention relates to a vane pump.

2. The Related Art of the Invention

Typically a cover for a vane pump is provided with complicated oil passages at a part of the cover and as a result, the strength of the cover itself is possibly damaged. Hence, a conventional pump for the purpose of maintaining the strength of the cover is disclosed in Japanese Unexamined Patent Publication JP7-279871A.

The conventional pump is provided with a concave portion formed at a joint face of the cover to a pump body, and an outer side plate made of iron sintered alloy is fitted into the concave portion as a reinforcing member. The rigidity of a cover side including the outer side plate is maintained by thus incorporating the outer side plate into the concave portion formed in the cover. And the outer side plate also serves to cover groove-shaped oil passages formed in the cover.

Portions of the outer side plate corresponding to the oil passages are not in contact with the cover. Since the part of the outer side plate is thus not in contact with the cover, a contact area between the outer side plate and the cover is made smaller.

SUMMARY OF THE INVENTION

When the outer side plate is incorporated into the cover side as described above, the thickness of the cover at a portion where the outer side plate is incorporated becomes substantially thinner. When the thickness of the cover thus becomes thinner, the strength of the thinner portion of the cover is reduced. And since the contact area between the outer side plate and the cover is small, when the vane pump is used as a high-pressure pump, deformation and buckling of the cover are more likely to occur.

Further, since the concave portion is formed in the cover and the outer side plate is incorporated into the concave portion, a flatness of a bottom face in the concave portion or parallelism of the bottom face in the concave portion to a side face of the cover brought in contact with the body are accurately managed. If dimensional accuracy thereof deteriorates, the outer side plate is not maintained to be perpendicular to a drive shaft, so that a clearance is produced between the outer side plate and a cam ring, possibly reducing volume efficiency of the pump. And when perpendicularity of the outer side plate to the drive shaft is not maintained as described above, metallic contact between the outer side plate and a rotor occurs, possibly causing seizing thereof.

In view of the above, there exists a need for a vane pump which overcomes the above-mentioned problems in the related art. The present invention addresses this need in the related art and also other needs, which will become apparent to those skilled in the art from this disclosure.

The present invention has an object of providing a vane pump, which can increase strength of a cover without an accurate dimensional control of the cover.

In order to achieve above the object the invention provides a vane pump. The vane pump comprises a body, a cam ring arranged in a body bore formed in the body, a rotor arranged in an inside of the cam ring, a plurality of vanes arranged on an outer surface of the rotor, the plurality of the vanes moving in and out along an inner surface of the cam ring with rotation of the rotor, a cover fastened to the body to cover an opening face of the body bore, and an iron reinforcing plate arranged in the body bore to be placed between the cam ring and the cover.

According to one aspect of the present invention, since an iron reinforcing plate is incorporated into a body bore, a substantial thickness of a cover with the iron reinforcing plate is the same as a cover having an increased thickness. Therefore, the strength of the cover is increased to reduce a distortion amount of the cover. Reduction in a distortion amount of the cover causes reduction in oil leakage inside the cover and thereby, volume efficiency of the pump is improved, preventing occurrence of oil leakage from a contact portion between a body and the cover. Since a concave portion for incorporating a plate into a cover side as shown in the conventional pump is not necessary, an accurate dimensional control with regard to the cover is not required.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

The preferred embodiments according to the invention will be explained below referring to the drawings, wherein.

DETAILED DESCRIPTION OF THE PREFERRED EMBODIMENT

Selected preferred embodiments of the present invention will now be explained with reference to the drawings. It will be apparent to those skilled in the art from this disclosure that the following description of the preferred embodiments of the present invention is provided for illustration only, and not for the purpose of limiting the invention as defined by the appended claims and their equivalents.

Figure 1:
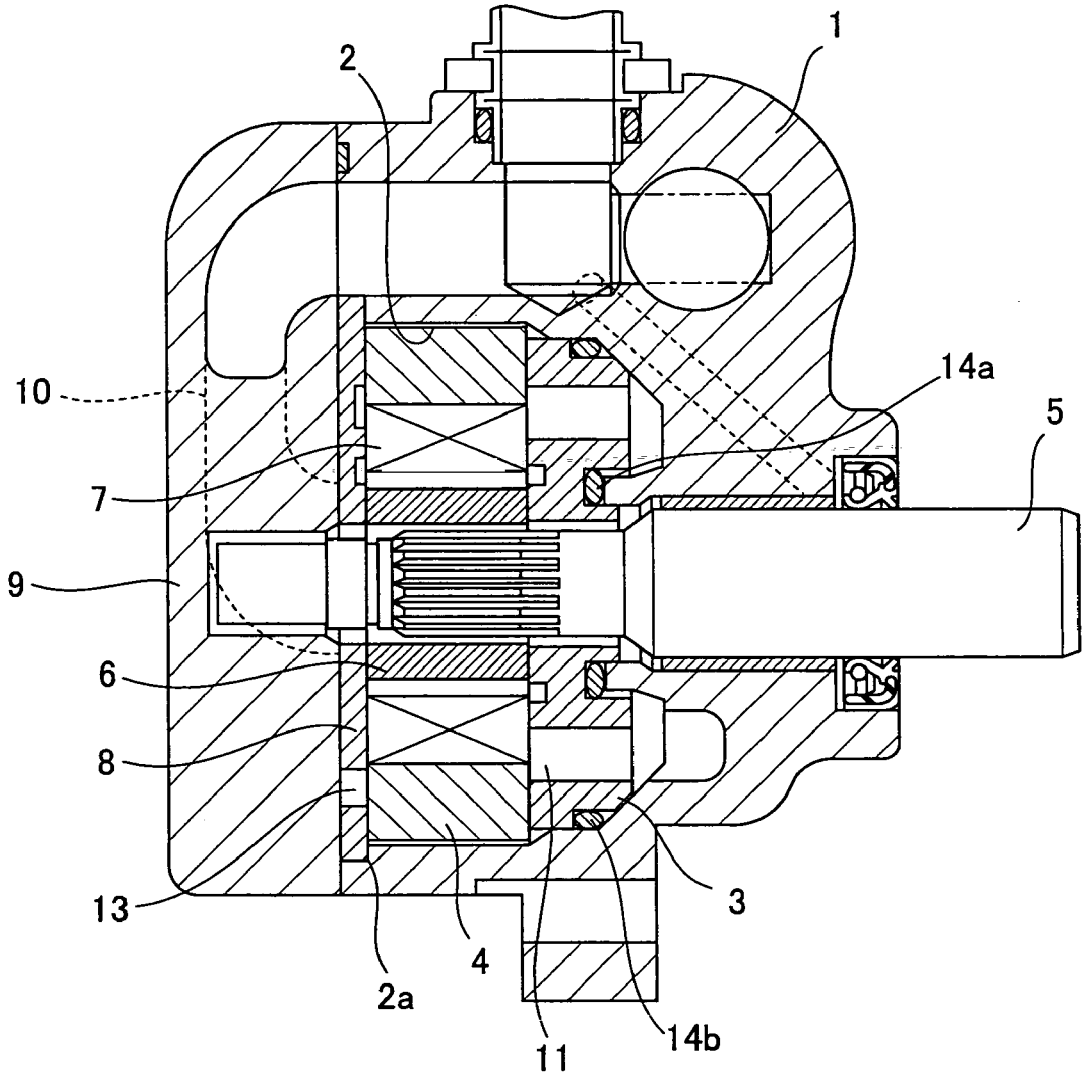
FIG. 1 is a cross sectional view showing a first preferred embodiment of the present invention.
Figure 2:
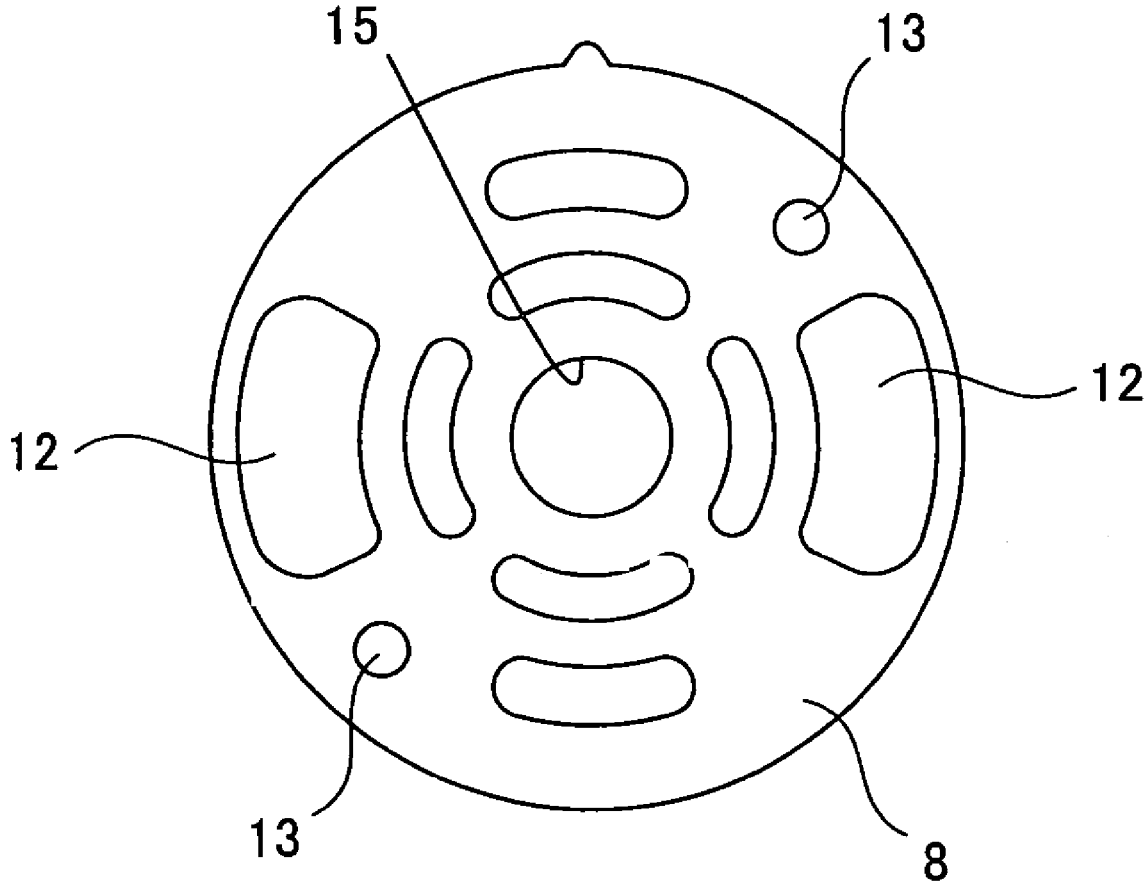
FIG. 2 is a view showing a contact face between a reinforcing plate and a rotor.
Figure 3:
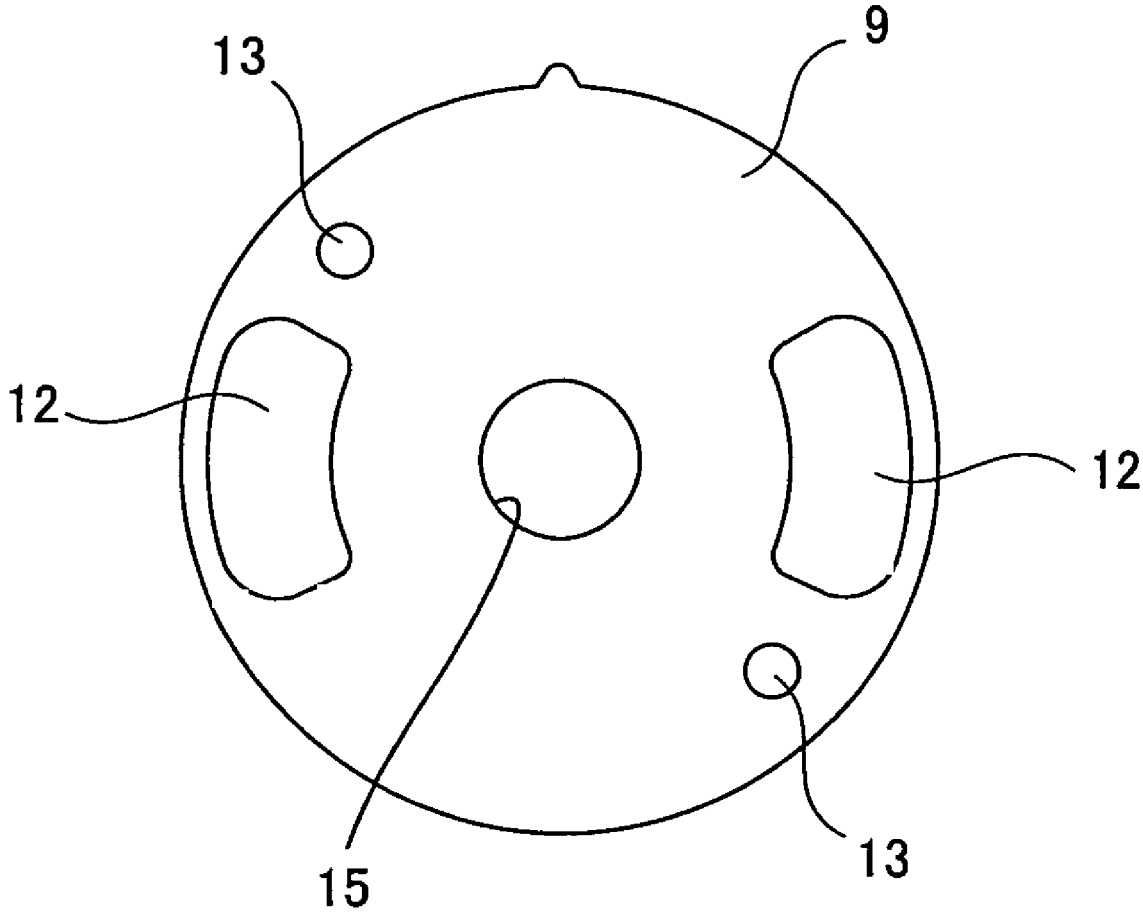
FIG. 3 is a view showing a contact face between a reinforcing plate and a cover.

In a first preferred embodiment shown in FIG. 1 to FIG. 3, a body bore 2 is formed in an aluminum-forged body 1 and an iron side plate 3 and an iron cam ring 4 are incorporated into the body bore 2.

A drive shaft 5 is provided in the body 1 to go through a center of each of the side plate 3 and the cam ring 4. An iron rotor 6 is provided on the drive shaft 5 in the cam ring 4 to rotate together with the drive shaft 5, and also a plurality of grooves are radially formed on an outer periphery of the rotor 6. Vanes 7 are incorporated into the grooves to move therein and out thereof.

A receiving step portion (concave portion) 2*a* is formed in an opening of the body bore 2 along an inner peripheral face thereof to incorporate a reinforcing plate 8 into the receiving step portion 2*a*. The reinforcing plate 8 is incorporated into the receiving step portion 2*a* and further, an outside of the reinforcing member 2*a* is covered with a cover 9.

The receiving step portion 2*a* for receiving the reinforcing plate 8 has a step (depth), which is greater by a small margin that the thickness of the reinforcing plate 8. If the step is smaller than the thickness of the reinforcing plate 8, the reinforcing plate 8 is projected from the body bore 2 into a side of the cover 9. When the reinforcing plate 8 is thus projected into the side of the cover 9, a clearance is produced in a mating face between the cover 9 and the body 1 and oil leakage occurs through the clearance.

Since O-rings 14*a* and 14*b* are interposed between the side plate 3 and the body bore 2 at a contact face thereof in the direction of the drive shaft 5, variations in the thickness of the side plate 3, the cam ring 4, the reinforcing plate 8 or the like are absorbed, thus bringing the reinforcing plate 8 in contact with the cover 9.

FIG. 2 shows a contact face of the reinforcing plate 8 to the rotor side and FIG. 3 similarly shows a contact face thereof to the cover side where a pair of suction apertures 12, are formed in the reinforcing plate 8. These suction apertures 12 communicate with a suction passage 10 formed in a tunnel shape in an inside of the cover 9. A pair of pin apertures 13 are formed in the reinforcing plate 8 and pins (not shown) to position the reinforcing plate 8 are inserted respectively into the pin apertures 13. Pins (not shown) projected in the cover side are inserted into the pin apertures 13, and further, the pins are also inserted into the cam ring 4 and the side plate 3 to be positioned with each other. A through hole 15 is formed in a center of the reinforcing plate 8 for the drive shaft 5 to be inserted therein.

The reinforcing plate 8 is made of iron sintered metal and therefore, the dimensional control of the reinforcing plate 8 can be accurately performed. Since each of the side plate 3, the cam ring 4, the rotor 6, and the reinforcing plate 8 is made of iron metal, the dimensional control thereof is accurately performed. Therefore, in the case of providing the receiving step portion. 2*a*, the reinforcing plate 8 and the receiving step portion 2*a* are accurately positioned.

The cover 9 closing an opening side of the body bore 2 is an aluminum cover 9. Closing the opening side with the cover 9 thus allows an incorporation structure where the reinforcing plate 8 is interposed between the cam ring 4 and the cover 9, and a substantial increase in rigidity in the side of the cover 9 from the reinforcing plate 8 is made.

The suction passage 10 is formed in a tunnel shape in the cover 9, whereby a contact area of the cover 9 with the reinforcing plate 8 can be made to be greater.

Operations of the vane pump will be explained. The drive shaft 5 is rotated with power of a driving source such as an engine or an electric motor, thereby rotating the rotor 6. When the rotor 6 is rotated, the vanes 7 incorporated in the rotor 6 move outwards until the vanes 7 contact an inner peripheral face of the cam ring 4 by a centrifugal force. Each vane 7 moves in and out in along the shape of the inner periphery of the cam ring 4 caused by rotation of the rotor 6.

The moving in and out of the vanes 7 along the cam ring 4 allows expansion or contraction of the chambers defined between the vanes 7. During the process when the chamber expands, a pressure in the chamber is reduced and as a result, hydraulic oil from the suction passage 10 of the cover 9 is suctioned into the chamber through the suction apertures 12 formed in the reinforcing plate 8. And during the process when the chamber contracts, a pressure in the chamber is increased and as a result, the high-pressure oil is discharged from a discharge port (not shown) through a communication bore 11 formed in the side plate 3.

In the preferred embodiment the reinforcing plate 8, as described above, is made of iron sintered metal, thereby improving sliding property of the reinforcing plate 8 to the rotor 6 or the vanes 7 and durability of the reinforcing plate 8 to the seizing. And since the rotor 6 or the vanes 7 are brought in contact with a side of the reinforcing plate 8, it is not necessary to improve slide-wear resistance in the cover 9. If the slide-wear resistance in the side of the cover 9 is desired to be improved, for example, the silicon content in the cover 9 has to be increased and as a result, the cover 9 becomes expensive, but in the preferred embodiment it is not necessary to provide an expensive cover 9.

And since in the preferred embodiment the suction passage 10 formed in the cover 9 is formed in a tunnel shape, the reinforcing plate 8 is evenly brought in contact with an entire surface of the cover 9. However, if the oil passage formed in the cover 9 is used as the groove, which is covered with the reinforcing plate 8, the reinforcing plate 8 is perceived to be floating by the width amount of the groove. In other words, the strength of the portion of the reinforcing plate 8 corresponding to the groove is reduced. In contrast to this, in the preferred embodiment the reinforcing plate 8 is evenly brought in contact with the cover 9 and as a result, the strength of the reinforcing plate 8 is not reduced.

Further, if the groove used as the suction passage, as described above, is opened to the contact face side of the cover, the strength of the opened portion of the cover is reduced. Reduction in the strength of the cover results in distortion of the cover when used under high pressure, causing oil leakage. In the preferred embodiment, however, the iron reinforcing plate 8 is incorporated into the body bore 2, which is, in terms of the strength of the cover, the same as a substantial increase in the thickness of the cover 9. As a result, the strength of the cover portion composed of the reinforcing plate 8 and the cover 9 is increased corresponding to the substantial increase, thereby reducing a distortion amount of the cover portion. When the distortion amount of the cover portion is reduced, the oil leakage inside the cover is reduced and the volume efficiency of the pump is improved, and further, the oil leakage from the contact portion between the body 1 and the cover 9 is prevented. Furthermore, since the concave portion for incorporating the plate into the cover side shown in the conventional pump is not required, an accurate dimensional control of the cover 9 is not required.

Two pin apertures 13 for the positioning are located in the reinforcing plate 8 opposed to each other in the circumferential direction of the reinforcing plate 8 and a respective positioning pin penetrates through each of the two pin apertures 13 between the side plate 3 and the cover 9. The reinforcing plate 8, as well as the side plate 3 are made of sintered metal, whereby the communicating bore 11 and the suction aperture 12 are accurately and relatively easily positioned corresponding to a change in pressures in the chambers formed between the vanes 7. And with this, fluctuations of the pump discharge pressure can be reduced.

Figure 4:
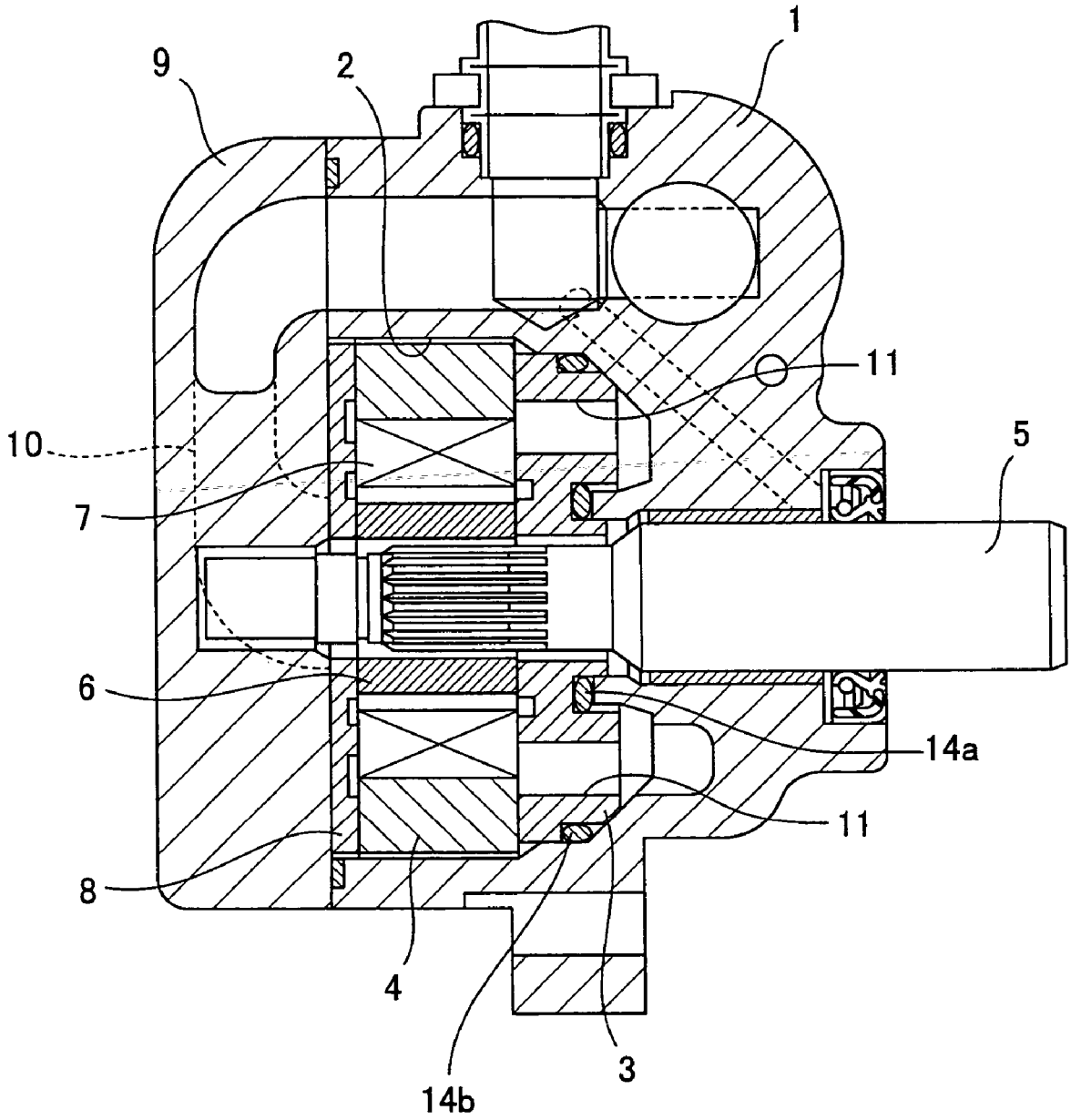
FIG. 4 is a cross sectional view showing a second preferred embodiment of the present invention.

Next, a second preferred embodiment will be explained with reference to FIG. 4.

In the preferred embodiment, an outer diameter of the reinforcing plate 8 is equal to that of the cam ring 4. With this, the reinforcing plate 8 can be incorporated directly into the body bore 2 receiving the cam ring 4, resulting in no necessity of the receiving step portion 2*a* shown in FIG. 1.

In a case the reinforcing plate 8 is thus incorporated directly into the body bore 2, the thickness of the reinforcing plate 8 may vary within the compressed amount of the O-ring 14*a* to the clearance formed between the cam ring 4 and the cover 9. Thereby, the rotor 6 and also the reinforcing plate 8 are pushed to the side of the cover 9 with the pump discharge pressure applied to the side of the side plate 3. As a result, no clearance is produced between the reinforcing plate 8 and the cover 9. In other words, the reinforcing plate 8 is closely in contact with the cover 9, thus completely preventing oil leakage therebetween.

This application claims priority to Japanese Patent Application No. 2004-179187. The entire disclosure of Japanese Patent Application No. 2004-179187 is hereby incorporated herein by reference.

The present invention is not limited to the above-described preferred embodiment, but it is apparent to those skilled in the art that the present invention includes various improvements and modifications within the scope of the technical concept of the present invention as defined in the appended claims.

What is claimed is:

1. A vane pump, comprising:

a body having a body bore formed therein, the body bore having an opening face, and a receiving step portion formed in the opening face, the receiving step portion having a depth;

a cam ring arranged in the body bore;

a rotor arranged inside of the cam ring;

a plurality of vanes arranged on an outer surface of the rotor, the plurality of vanes moving in and out along an inner surface of the cam ring with a rotation of the rotor;

a cover fastened to the body to cover an opening face of the body bore; and an iron reinforcing plate arranged in the body bore, being received in the receiving step portion, and being placed between the cam ring and the cover, the reinforcing plate being formed of iron sintered alloy, and having a maximum thickness that is less than a depth of the receiving step portion; and an O-ring interposed in the body bore to press the cam ring against the reinforcing plate, thereby absorbing a clearance that would otherwise occur between the cover and the reinforcing plate.

2. The vane pump according to claim 1 wherein:

a suction passage is formed in a tunnel shape in the cover; and a suction aperture communicating with the suction passage is formed in the reinforcing plate.

* * * * *